US007641065B2

(12) United States Patent
Wang Wu

(10) Patent No.: US 7,641,065 B2
(45) Date of Patent: Jan. 5, 2010

(54) CANTEEN

(76) Inventor: Ching Yueh Wang Wu, P.O. Box 90, Tainan City 70499 (TW)

( * ) Notice: Subject to any disclaimer, the term of this patent is extended or adjusted under 35 U.S.C. 154(b) by 187 days.

(21) Appl. No.: 12/040,930

(22) Filed: Mar. 3, 2008

(65) Prior Publication Data

US 2009/0218309 A1 Sep. 3, 2009

(51) Int. Cl.
*B67D 5/00* (2006.01)

(52) U.S. Cl. ..... 215/387; 215/386; 222/505; 222/507; 222/521

(58) Field of Classification Search ..... 215/387, 215/386; 222/521, 153.06, 153.11, 153.14, 222/402.1, 494, 484, 520, 83.5, 505, 507, 222/548

See application file for complete search history.

(56) References Cited

U.S. PATENT DOCUMENTS 4,773,571 A * 9/1988 Hagan et al. ..... 222/394
5,145,094 A * 9/1992 Perlmutter ..... 222/153.14
5,284,277 A * 2/1994 Leuenberger ..... 222/521
5,431,305 A * 7/1995 Kaminski ..... 222/109
5,850,908 A * 12/1998 Jasek ..... 220/203.23
6,170,654 B1 * 1/2001 Gartner et al. ..... 206/219
6,672,333 B2 * 1/2004 Williamson et al. ..... 137/510
7,537,133 B2 * 5/2009 Naesje ..... 220/714
2003/0071085 A1 * 4/2003 Lasserre et al. ..... 222/521
2004/0251276 A1 * 12/2004 Adams et al. ..... 222/153.14

* cited by examiner

*Primary Examiner*—Anthony D. Stashick
*Assistant Examiner*—Cynthia F Collado

(57) ABSTRACT

A canteen is composed of a main body, a cover, a control unit, a valve and an annular blocker. The cover is engaged with the main body, having a jointing tube protruding into the main body and two notches cut in the jointing tube. The control unit is fixed on the cover, having a jointing portion, two grooves formed in the jointing portion and reversely shaped to correspond to the notches of the cover, and a sucker bored with an outlet. The valve is installed in the control unit, having a bar to correspond to the outlet, and a guiding rod transversely extended out from its bottom to extend through the grooves and the notches of the cover. When rotating the control unit, the valve is moved up and down to be separated from or to clog the outlet, convenient for using and preventing the suction portion from contaminated.

7 Claims, 4 Drawing Sheets

CANTEEN

BACKGROUND OF THE INVENTION

1. Field of the Invention

This invention relates to a canteen particularly to one composed of a main body, a cover, a control unit and a valve, with the valve moved up and down to keep an outlet opened or clogged by rotating the control unit, neither necessary to open the cover nor to touch the outlet, assuring hygienic drinking.

2. Description of the Prior Art

Commonly, a conventional canteen is provided with an opening formed on its top for being sealed with a cover to prevent the water contained in it from leaking out, conveniently carried around. But, the cover has to be loosely screwed and taken away so as to pour out the water in the canteen when a user is to drink it, practically inconvenient for using. FIG. 1 shows an improved conventional canteen that can be directly used without removing its cover, provided with a main body 11 having an opening 110 sealed with a cover 12 that is provided with a small-diameter mouth 120 formed on its top, a bolt 121 and a control valve 13 positioned inside the mouth 120. The control valve 13 has its top covering on the mouth 120, provided with an outlet 130 centrally formed in its top to exactly corresponding to the bolt 121, and able to be manually moved up and down inside the mouth 120 to keep the outlet 130 opened (or moved up) or closed (or moved down). However, with the control valve 13 repeatedly pulled up and pressed down in the cover 12 while using, not only is the outlet 130 always contacted by fingers to get contaminated, downgrading sanitation, but also the outer wall of the control valve 13 is to rub against the inner wall of the mouth 120 to form a gap between them, causing leakage of the water in the canteen while tilting the canteen. Moreover, the control valve 13 may not be stably positioned when pulled up, keeping the water in the canteen unable to be smoothly poured out.

SUMMARY OF THE INVENTION

The object of this invention is to offer a canteen able to let a user drink the water in it without opening the cover and touching its suction portion to assure drinking sanitation.

The main characteristics of the invention are a main body, a cover, a control unit, a valve and an annular blocker. The main body is provided with an opening formed at its top. The cover is engaged with the opening of the main body, provided with a jointing tube formed in its central portion to protrude into the opening of the main body, and two notches symmetrically cut at two sides of the jointing tube. The control unit is fixed on the cover, provided with a jointing portion formed at its lower portion, a sucker formed at its upper portion and having an outlet bored in its center, and two grooves formed at two sides of the jointing portion and reversely shaped. The valve is installed inside the control unit, provided with a bar formed on its top for corresponding to the outlet of the control unit, and a guiding rod transversely extended out from two sides of its bottom to extend through the grooves of the control unit and the notches of the cover. The annular blocker is fixed at the bottom of the control unit.

BRIEF DESCRIPTION OF DRAWINGS

This invention is better understood by referring to the accompanying drawings, wherein.

DETAILED DESCRIPTION OF THE PREFERRED EMBODIMENT

Figure 1:
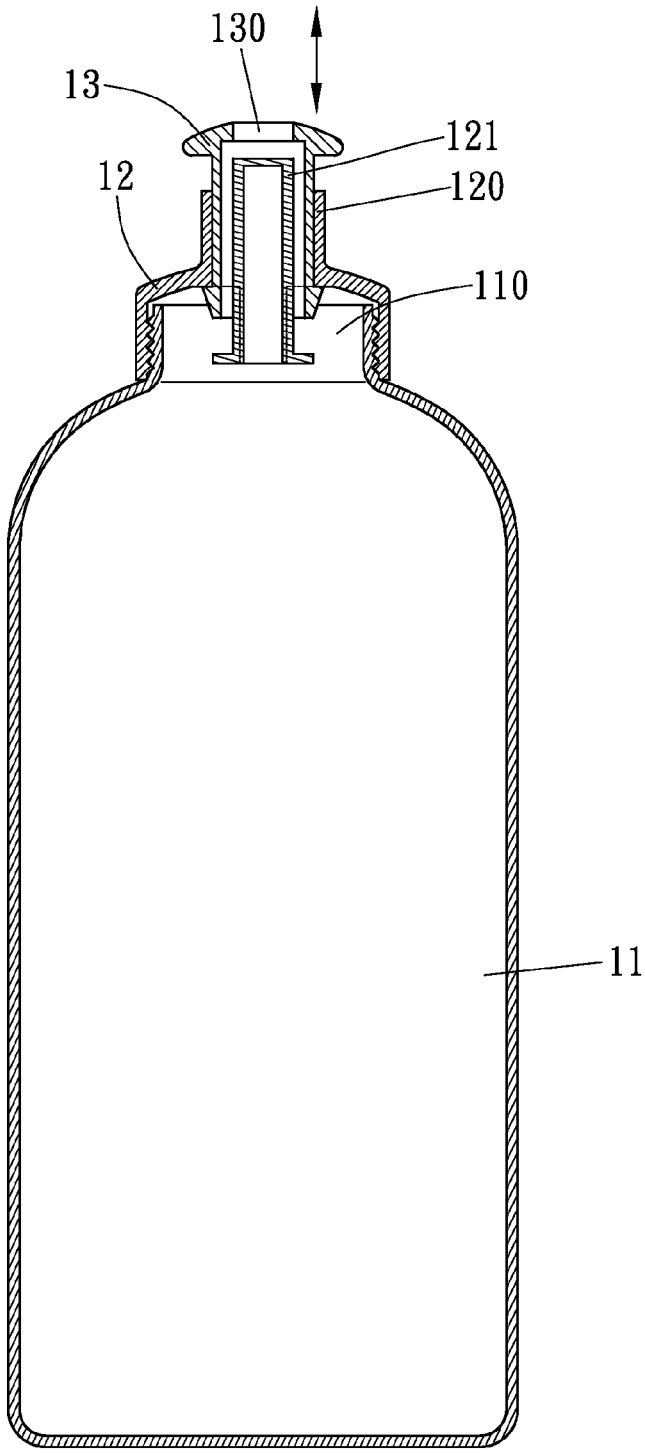
FIG.1 (PRIOR ART)
FIG. 1 is a cross-sectional view of a conventional canteen.
Figure 2:
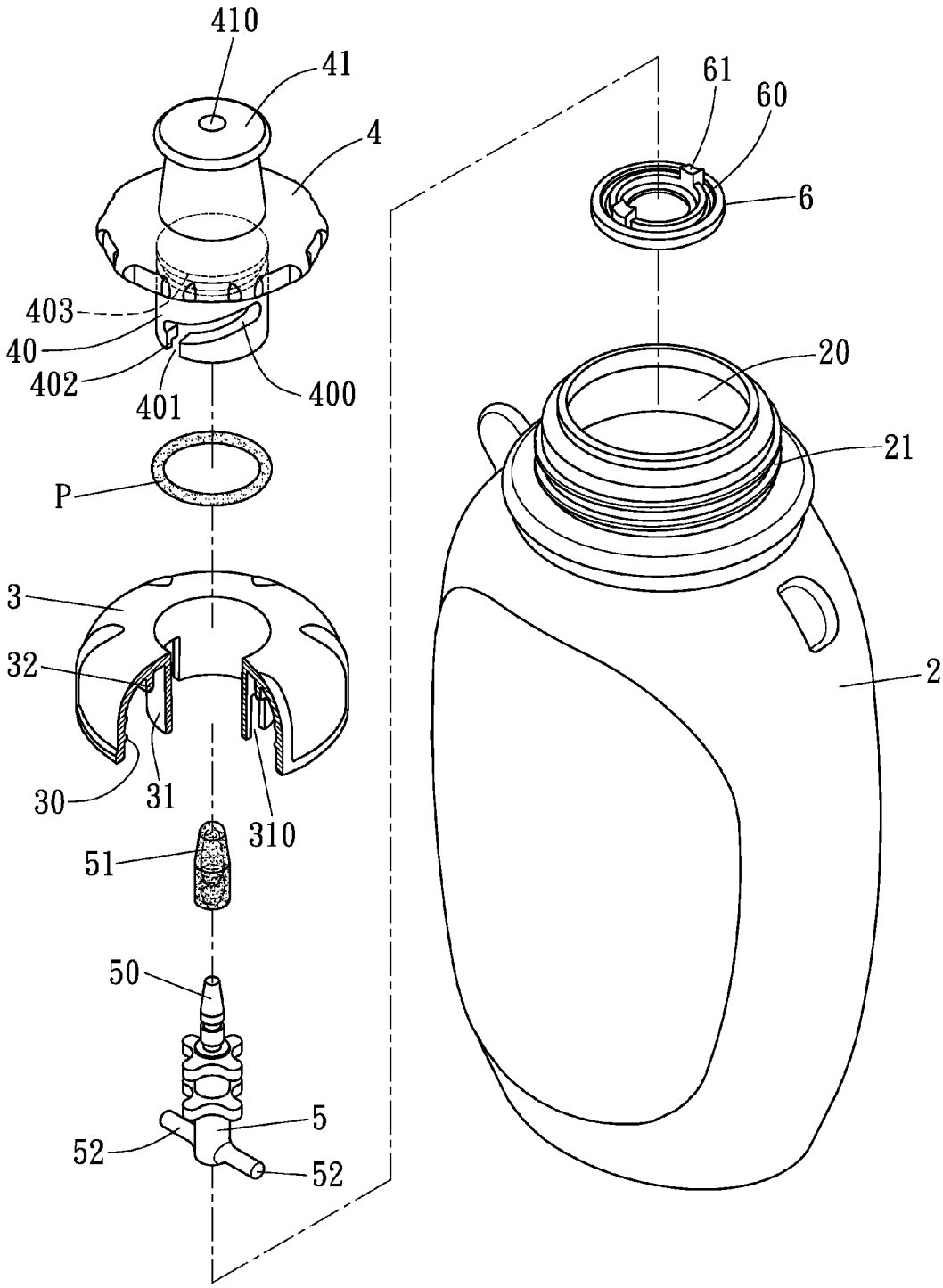
FIG. 2 is an exploded perspective view of a preferred embodiment of a canteen in the present invention.

As shown in FIG. 2, a preferred embodiment of a canteen in the present invention is composed of a main body 2, a cover 3, a control unit 4, a valve 5 and an annular blocker 6.

The main body 2 is provided with an opening 20 formed at its top, and a male-threaded portion 21 formed around the outer wall of the opening 20.

The cover 3 is engaged with the opening 20 of the main body 2, provided with a female-threaded portion 30 formed around its inner wall for engaging with the male-threaded portion 21 of the main body 2, a jointing tube 31 formed in its central portion to protrude into the opening 20 of the main body 2, and an annular projection 32 located around between the tube 31 and the female-threaded portion 30 to lean on the top of the inner wall of the opening 20. The jointing tube 31 has two notches 310 cut symmetrically.

The control unit 4 is fixed on the cover 3, provided with a jointing member 40 formed at its lower portion, and a sucker 41 formed at its upper portion. The jointing member 40 is provided with two grooves 400 respectively formed at its two corresponding sides and reversely shaped, a notch 401 formed in the lower end of each of the grooves 400, a plugging end 402 formed around its bottom, and an annular groove 403 formed above the grooves 400 for fitting with a gasket (P). An outlet 410 is bored in the center of the sucker 41.

The valve 5 is installed inside the control unit 4, provided with a bar 50 formed on its top for corresponding to the outlet 410 of the sucker 41 of the control unit 4, a flexible covering 51 used to be capped on the bar 50, and a guiding rod 52 transversely extended out from two sides of its bottom to pass through the grooves 400 of the control unit 4 and the notches 310 of the cover 3.

The annular blocker 6 is fixed at the bottom of the control unit 4, bored with a through hole in its center, and provided with an annular groove 60 and two symmetrical projections 61.

Figure 3:
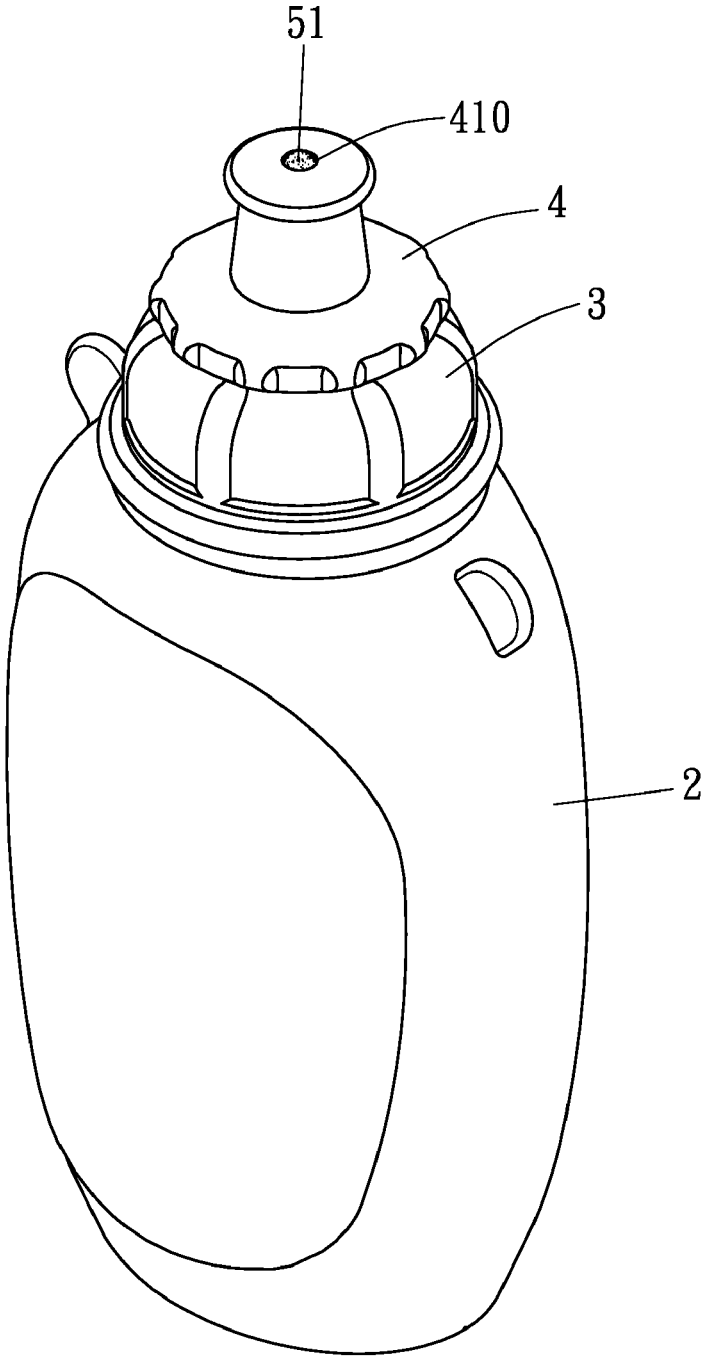
FIG. 3 is a perspective view of the preferred embodiment of a canteen in the present invention.
Figure 4:
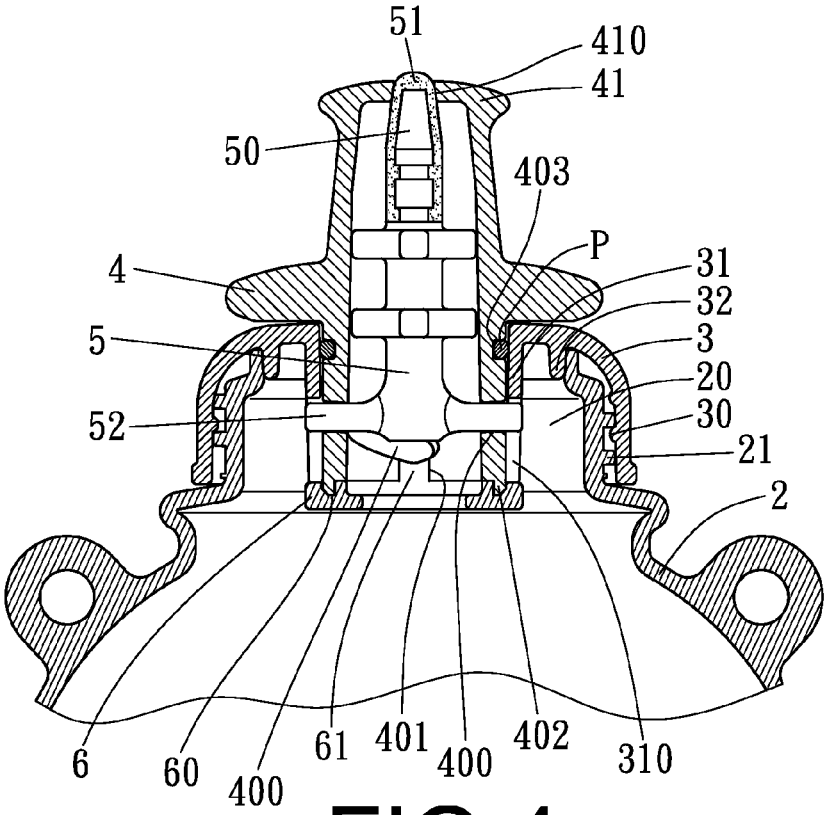
FIG. 4 is a cross-sectional view of the preferred embodiment of a canteen in the present invention, showing an outlet being clogged by a valve.

In assembling, as shown in FIGS. 2~4, the gasket (P) is first fitted in the annular groove 403 of the jointing member 40 of the control unit 4 and then put the control unit 4 into the jointing tube 31 of the cover 3, with the notches 401 of the jointing portion 40 of the control unit 4 exactly corresponding to the notches 310 of the jointing tube 31 of the cover 3. Next, after having the covering 51 mounted on the bar 50, the valve 5 is put into the control unit 4 from the bottom of the cover 3, with the guiding rod 52 of the valve 5 inserted from the notches 401 of the jointing portion 40 of the control unit 4 and the notches 310 of the jointing tube 31 of the cover 3 to move in the grooves 400 of the control unit 4, and with the covering 51 of the valve 5 exactly facing to the outlet 410 of the suction portion 41 of the control unit 4. The annular blocker 6 is successively fixed in the bottom of the control unit 4, keeping the plugging end 402 of the control unit 4 fitted in the annular groove 60 of the annular blocker 6, and the projections 61 of the annular blocker 6 restricted in the notches 401 of the jointing portion 40. Finally, the cover 3 can be engaged with the opening 20 of the main body 2 to finish the assembly of the canteen.

Figure 5:
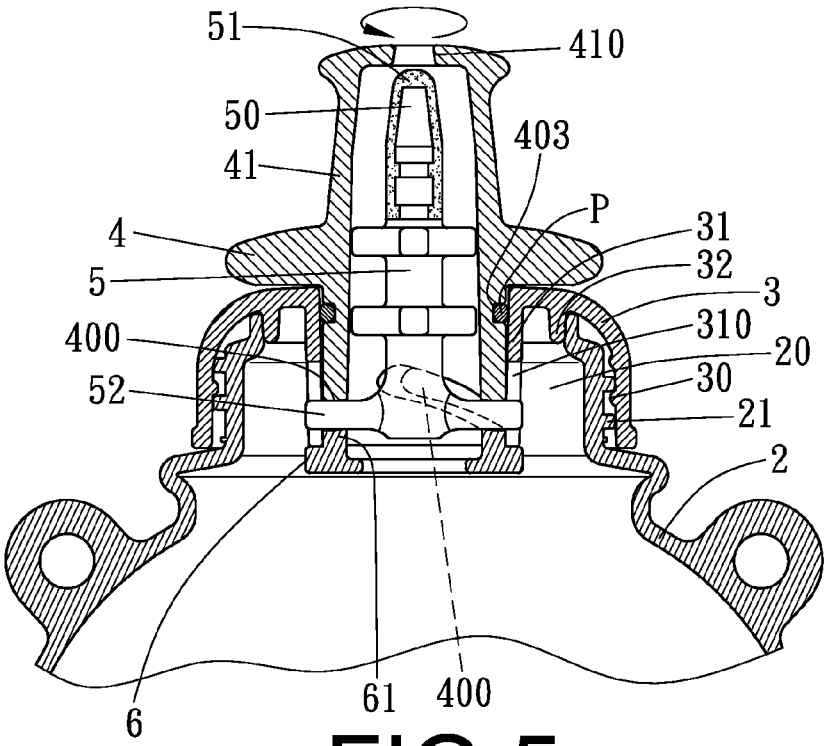
FIG. 5 is a cross-sectional view of the preferred embodiment of a canteen in the present invention, showing it being operated to keep the outlet freed from the valve.

In using, as shown in FIGS. 4 and 5, the operation of the canteen functioned by rotating the control unit 4 to keep the guiding rod 52 of the valve 5 restricted in the grooves 400 of the control unit 4 and the notches 310 of the cover 3 to only move up or down so that the covering 51 of the valve 5 may clog up or be separated from the outlet 410. That is, a user needs only to rotate the control unit 4 to force the guiding rod 52 of the valve 5 moved downwards along the grooves 400 of the control unit 4 and restricted in the notches 310 of the cover 3, keeping the valve 5 merely moved down vertically without whirling together with the control unit 4, so as to have the covering 51 of the valve 5 separated from the outlet 410 of the suction portion 41 to make it ready for drinking. On the contrary, the control unit 4 can be reversely rotated to force the valve 5 moved up, so that the covering 51 of the valve 5 can be as well moved up to block the outlet 410 to prevent the water in the canteen from leaking out.

Therefore, the canteen of the invention can be operated, not only unnecessary to open the cover 3 but also to touch the sucker 41 and the outlet 410, convenient for using and assuring sanitary drinking.

While the preferred embodiment of the invention has been described above, it will be recognized and understood that various modifications may be made therein and the appended claims are intended to cover all such modifications that may fall within the spirit and scope of the invention.

What is claimed is:

1. A canteen comprising:

a main body provided with an opening formed at its top;

a cover engaged with said opening of said main body and provided with a jointing tube formed in its central portion to protrude into said opening of said main body, said jointing tube provided with two notches cut symmetrically;

a control unit fixed on said cover and provided with a jointing portion formed at its lower portion, a sucker formed at an upper portion of said control unit and having an outlet bored in its center, said jointing portion provided with two grooves respectively formed at its two sides and reversely shaped;

a valve installed inside said control unit and provided with a bar formed on its top for corresponding to said outlet of said control unit, a guiding rod transversely extended out from two sides of a bottom of said valve to extend through said grooves of said control unit and said notches of said cover; and an annular blocker fixed at a bottom of said control unit.

2. The canteen as claimed in claim 1, wherein said main body is provided with a male-threaded portion formed around an outer wall of said opening.

3. The canteen as claimed in claim 1, wherein said cover is provided with a female-threaded portion.

4. The canteen as claimed in claim 1, wherein said cover is provided with an annular projection formed around outside said jointing tube to lean on a top of an inner wall of said opening of said main body.

5. The canteen as claimed in claim 1, wherein said jointing portion of said control unit is provided with a notch cut in a lower end of each of said grooves, a plugging end formed around a bottom of said jointing portion, and a gasket fitted around said jointing portion.

6. The canteen as claimed in claim 1, wherein said bar of said valve is capped by a flexible covering.

7. The canteen as claimed in claim 1, wherein said annular blocker is bored with a through hole at its center and provided with an annular groove and two projections.

* * * * *